United States Patent [19]

Newlands

[11] Patent Number: 4,942,890

[45] Date of Patent: Jul. 24, 1990

[54] CONTAINER FOR SCALP PRODUCTS AND BASE THEREFOR

[76] Inventor: Paulo R. J. Newlands, Rua Fadel Fadel 112/103, Gávea, Rio de Janeiro 22430, Brazil

[21] Appl. No.: 256,572

[22] Filed: Oct. 12, 1988

[51] Int. Cl.[5] ..... A45D 7/02

[52] U.S. Cl. ..... 132/212; 132/320; 401/28; 401/131; 401/209

[58] Field of Search ..... 132/112, 115, 152, 212, 132/155, 221, 151, 320; 401/28, 131, 209, 268; 211/60.1, 71, 162

[56] References Cited

U.S. PATENT DOCUMENTS

| | | | |
|---|---|---|---|
| 2,282,661 | 5/1942 | Lewis | 211/71 |
| 2,818,979 | 1/1958 | Rose | 211/60.1 |
| 2,954,876 | 10/1960 | Mathews | 211/162 |
| 3,111,703 | 11/1963 | Kaufman | 132/320 |
| 3,214,031 | 10/1965 | McCauley | 211/71 |
| 4,228,905 | 10/1980 | Cammarota | 211/71 |
| 4,326,508 | 4/1982 | Stauffer | 401/28 |
| 4,823,777 | 4/1989 | Goncalves et al. | 401/28 |

FOREIGN PATENT DOCUMENTS

| | | | |
|---|---|---|---|
| 2504367 | 10/1982 | France | 132/320 |
| 2082124 | 3/1982 | United Kingdom | 401/209 |

*Primary Examiner*—John J. Wilson
*Assistant Examiner*—Frank A. LaViola, Jr.
*Attorney, Agent, or Firm*—Beveridge, DeGrandi & Weilacher

[57] ABSTRACT

A container for products applicable to the scalp comprising an elongated and hollow reservoir portion with a base end and an application end opposite each other, a housing being formed at the application end which houses a sphere or revolution body that freely revolves therein, the object of the invention being that of providing a container of this type which allows a more accurate dosage of the product contained therein and a simultaneous application with other products in the desired proportions. This object is achieved by providing a flange portion integral with the reservoir portion near the base end of the reservoir portion, the container being individually fittable onto a support that is common to other similar containers. The present invention further proposes a support base with fitting elements to receive a plurality of containers of this type.

13 Claims, 3 Drawing Sheets

CONTAINER FOR SCALP PRODUCTS AND BASE THEREFOR

Figure 1:
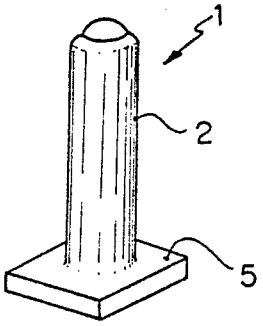

The invention refers to a container for products applicable to the scalp and other parts of the body comprising an elongated and hollow portion with a base end and an application end, which houses a sphere or revolution body that freely revolves therein. The invention also refers to a support base for containers of this type.

Containers of the type described are used especially to apply products against baldness, seborrhoea, mycosis and lice, while massaging the scalp, and are already known from the French application No. 2,504,367, which describes and illustrates a device in which a plurality of hollow teeth provided with a sphere or a truncated cone is connected to a common reservoir having a filling orifice. This know device permits the application of fluid, or fine powdered products, to hair-covered surfaces, the product being dispensed by means of pressure exerted on the sphere or truncated cone during application, according to a principle analogous to that of a ball-point pen or "roll-on" type deodorant.

As in this known device, there has always been a tendency to connect the hollow space of each tooth fluidically to a common reservoir, as illustrated in the French application No. 2,422,359 and U.S. Pat. Nos. 4,213,473 and 4,585,018.

However, these known devices have a series of disadvantages. First, these devices do not permit one to dose the amount of product to be applied; besides, the product cannot be selectively applied with other products, that is to say, in the case of the application of different medicines to the scalp, in which two or more products cannot be mixed before application and/or in the case of products having different frequencies of application (for instance, a product A should be applied daily and a product B only every other day), the devices of the prior art require the user to utilize a device for each product. This not only represents an inconvenience in terms of costs, but also compels the user to carry out an applications with each device, which makes this procedure more tiresome.

Another inconvenience of these known devices is related to the asepsis. In the case of the device of the French application No. 2,504,367, for instance, organic residues from the scalp tend to accumulate around the various teeth, as the device is used. The fact that the device is a rigid assembly makes the cleaning thereof very difficult, mainly inside it, which requires an exchange of the device for a new one at intervals of time.

U.S. Pat. No. 1,847,347 and GB Pat. No. 597,112 disclose combs whose teeth can be disassembled one by one for the purpose of allowing a more effective cleaning thereof and the replacement of damaged teeth. These combs, however, are not adequate for the application of products to the scalp, like those devices already mentioned.

The object of the present invention is to provide a container adequate for the application of products to the scalp of the type described above, which does not have the inconveniences of the known devices, as well as a support base for containers of this type.

This object is achieved, according to the invention, by providing a flange portion integral with the reservoir portion near the base end of the reservoir portion, the container being individually fittable onto a support base that is common to other similar containers.

The support base for containers of this type proposed by the invention is characterized by comprising a main body equipped with fitting elements to receive said containers in a disengageable manner, the fitting elements being formed to retain the containers in the region of the flange portion of each container.

The container according to the invention can be sold already sealed with the product inside it, either individually or in continuous strips, from which each container can be pulled out.

Thus, the user can make the combinations of several products which he desires by fitting the respective containers onto the support base , and the dosage of the product to be applied can be adjusted in accordance with the number of containers for each product to be put onto said base.

The asepsis of the containers/base assembly is greatly facilitated by the fact that the containers can be removed from the base for the purpose of cleaning and by the fact that they can be pulled out, which eliminates the prolonged use of the same container, as occurs, for instance, with said French application No. 2,504,367.

Figure 2:
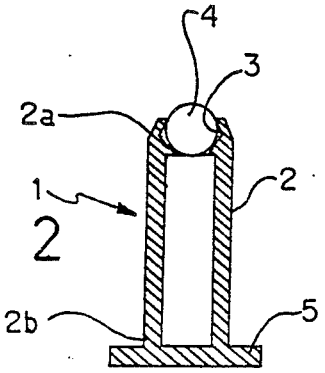
Figure 5:
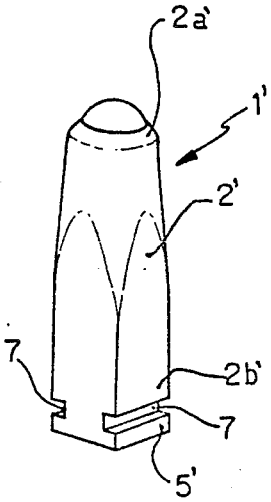
Figure 3:
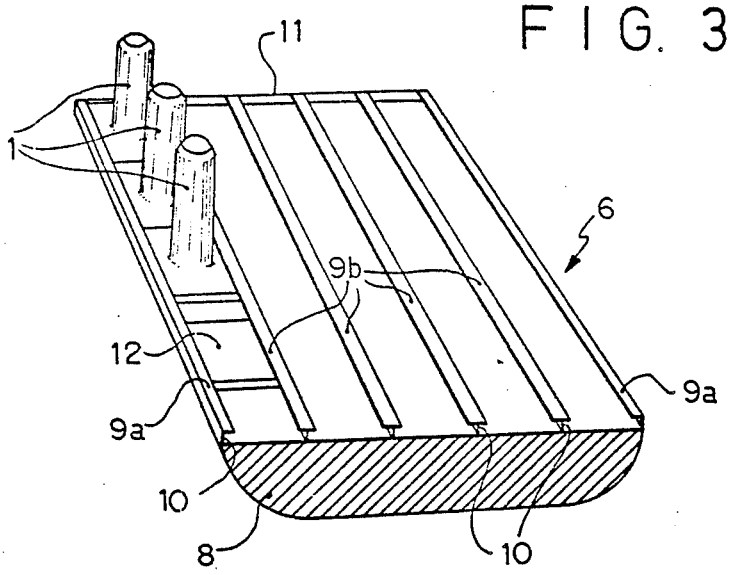
Figure 4:
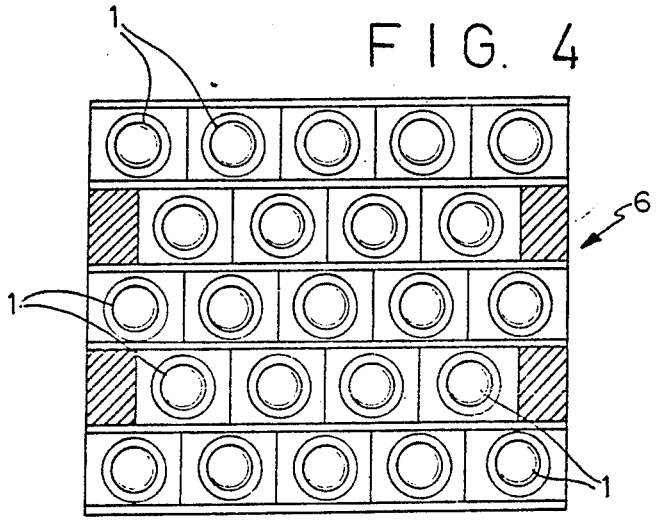
Figure 6:
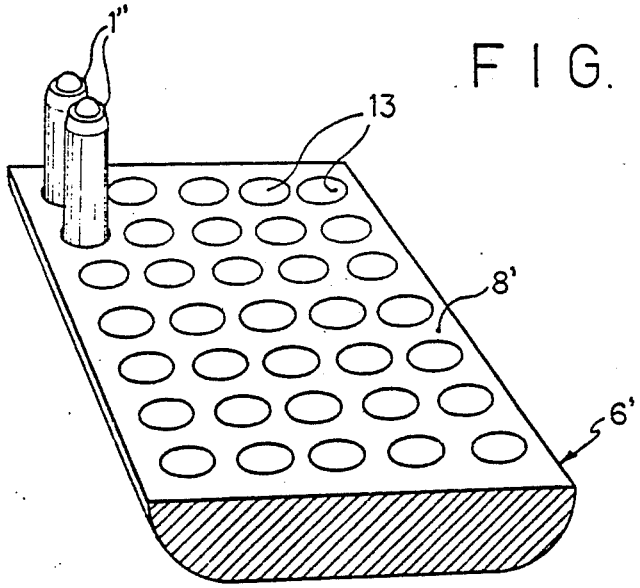
Figure 7:
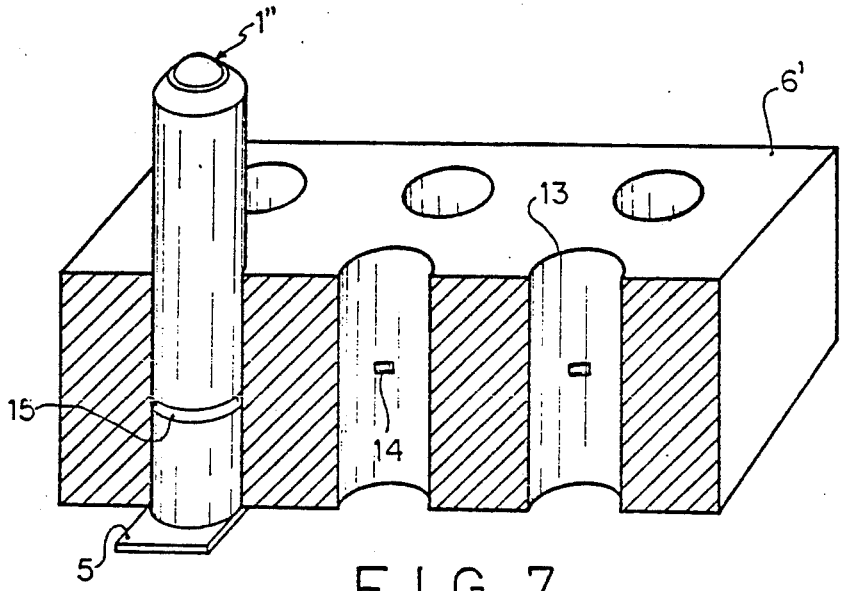

The invention will be described in greater detail below on the basis of an embodiment example represented in the drawings. The figures show:

FIG. 1 - an enlarged perspective view of a container according to the invention;

FIG. 2 - a side view in section of the container of FIG. 1;

FIG. 3 - a perspective view of the containers/support base assembly according to the invention;

FIG. 4 - an upper view of the containers/support base assembly with several containers fitted in a possible arrangement;

FIG. 5 - a perspective view of a constructive variant of the container;

FIG. 6 - a perspective view of a variant of the containers/base assembly; and FIG. 7 - an enlarged view, partially in section, of the assembly of FIG. 6.

As FIGS. 1 and 2 show, each container 1 comprises an elongated reservoir portion 2 at whose application end **2*a* a housing 3 is provided, which houses a sphere 4. The sphere 4** revolves freely so as to carry the product contained in the container onto the surface over which the device is displaced.

The improvement of the present invention lies in individualizing each container and providing a flange 5 integral with the base end **2*b* of the reservoir portion 2. This allows the container 2 to be individually fitted onto a common support base , in such a manner that it is possible to adjust the dosage of the product to be applied by accordingly varying the number of containers 1 to be fitted onto the support base 6. Also the final composition of the product applied can be altered in a simple manner, by fitting onto the support bases 6 containers 1** with different products.

Preferably, the reservoir portion 2 is cylindrical in shape and shows a slight conicity at the application end. The flange 5 has, preferably, a substantially rectangular shape, being, for instance, square.

A constructive variant, illustrated in FIG. 5, consists in that, in the container 1, the base end **2*b*' of the reservoir portion 2' has a square cross section, there being a suave transition between this square end and the application end 2*a*', which has a circular section. In this variant, the flange 5' can be formed by providing grooves 7 on opposite sides of the reservoir portion 2**.

The support base 2 comprises a main body 8 equipped with fitting elements *9a, 9b* to receive a plurality of containers 1. The fitting elements are preferably fitting rails *9a, 9b* parallel to each other and provided on the fitting surface of the body 8, the two end rails being shaped approximately as an inverted L, while the intermediate rails *9b* are shaped substantially as a T. The fitting rails *9a, 9b* form recesses 10 adequate for receiving the flange portion 5, 5' of the containers 1, the latter being fitted onto the support base 6 under pressure. Spacers 12 can be provided for occupying empty spaces between two consecutive containers 1.

The support base 6 can have its fitting surface in concave shape, in order to adjust to the user's head more easily. A stop element 11 can be provided at one of the ends of the fitting rails *9a, 9b,* so as to limit the displacement of the containers 1 during the fitting thereof. The support base can also be provided with a handle on the main body, on its side opposite the fitting surface of the containers. Additionally, a cover (not represented) fittable onto the side of the fitting surface of the containers can be provided, said cover being dimensioned so as to cover the containers that are coupled to the support base. The support base can also be provided with a series of shoulders or protuberances on the fitting surface, so as to provide a safer positioning and retention of the containers, thus avoiding the displacement thereof during the application.

The constructive variant illustrated in FIGS. 6 and 7 consists in that the support base 6' is provided, on its main body 8', with a plurality of openings 13, the cross section of which is adapted to that of the containers 1''. In this example, the containers 1'' are fitted from the lower side of the support base 6' by pressure, the inside of the openings 13 being provided with at least one fitting shoulder 14, which fits into a corresponding peripheral groove 15 provided in the container 1. A cover (not represented) can also be provided on the lower face of the support base, in order to prevent the displacement of the containers outwards, when the assembly is being used.

Besides the advantages referring to the possibility of adjusting the amount of the product applied and of applying several products in varying proportions simultaneously, the container in accordance with the invention provides an attractive alternative for manufacturers of products for the hair as regards the packing of the product, since the proposed container can be supplied to these manufacturers with the sphere removed, and the product can be injected into the container through its application end, the sphere being then fitted by pressure, which ensures the inviolability of the product, since it becomes extremely difficult to remove the sphere with out damaging the container after the sphere has been fitted thereinto. Thus, these containers can constitute the final packing of the product, in which the latter will be sold. The container can be manufactured at a low cost, for instance, made of injected plastic material, which makes it easily disposable.

I claim:

1. A container for a hand-held applicator for applying products to the scalp or other portions of the body, said container being small enough to permit a plurality of such containers to be mounted beside each other on a support base of the hand-held applicator so that a plurality of containers simultaneously apply their contents to the body, a hollow elongated reservoir portion having a base end and an application end opposite each other;

a housing inside said reservoir portion near said application end;

a rotatable body mounted in said housing for free rotation, means for fitting said container individually on said support base, said means including a flange portion for removably mounting said container to said support base.

2. The invention of claim 1 wherein said reservoir portion is substantially cylindrical with a slight conicity at said application end.

3. A container according to claim 1 in combination with a support base having mounting means for holding a plurality of said containers beside each other.

4. The invention of claim 3 wherein the mounting means includes fitting elements for engaging the flange portions of the containers.

5. The invention of claim 4 wherein the fitting elements include parallel fitting rails arranged on said main body, each fitting rail providing at least one recess for receiving a said flange portion.

6. The invention of claim 5 wherein said fitting rails include two L-shaped end rails and T-shaped intermediate rails.

7. The invention of claim 6 having a stop element at an end of said fitting rails.

8. The invention of claim 3 having a plurality of said containers mounted on said support base.

9. The invention of claim 8 wherein different said containers contain different compositions so that said applicator will simultaneously apply different compositions to the body.

10. The invention of claim 3 in which said support base has a concave surface from which said containers extend.

11. The invention of claim 3 in which the support base includes a substantially plane main body provided with a plurality of openings which each have a cross section corresponding to a cross sections of a said container.

12. The invention of claim 11 having fitting shoulders provided inside of said openings for retaining said containers.

13. The invention of claim 11 in which said openings are circular.

* * * * *